United States Patent [19]

Aeppli

[11] 4,311,958

[45] Jan. 19, 1982

[54] CAPACITIVE THREAD STOPPING MOTION

[75] Inventor: Kurt Aeppli, Uster, Switzerland

[73] Assignee: Zellweger, Ltd., Uster, Switzerland

[21] Appl. No.: 867,488

[22] Filed: Jan. 6, 1978

[30] Foreign Application Priority Data

Jan. 10, 1977 [CH] Switzerland ..... 1606/77

[51] Int. Cl.[3] ..... G01R 27/26; B65H 63/06; G01L 5/04

[52] U.S. Cl. ..... 324/61 R; 28/227; 57/265; 73/160; 340/677

[58] Field of Search ..... 324/61 R; 73/160, 159; 57/264, 265, 81; 340/675, 677; 28/227

[56] References Cited

U.S. PATENT DOCUMENTS 2,671,199 3/1954 Truitt ..... 324/61 R 3,031,616 4/1962 Hummel ..... 324/61 R 3,657,644 4/1972 Beam et al. ..... 324/61 R

FOREIGN PATENT DOCUMENTS 446740 12/1974 U.S.S.R. ..... 324/61 R

*Primary Examiner*—Ernest F. Karlsen

*Attorney, Agent, or Firm*—Craig and Antonelli

[57] ABSTRACT

A method and device for detecting the presence of a running thread takes advantage of the inherent physical irregularities of the thread to generate an alternating current signal as the thread passes through a capacitive element. The variations in capacitance resulting from the running thread are detected and amplified as an alternating current electrical signal, which disappears instantly with thread stoppage or breakage.

5 Claims, 1 Drawing Figure

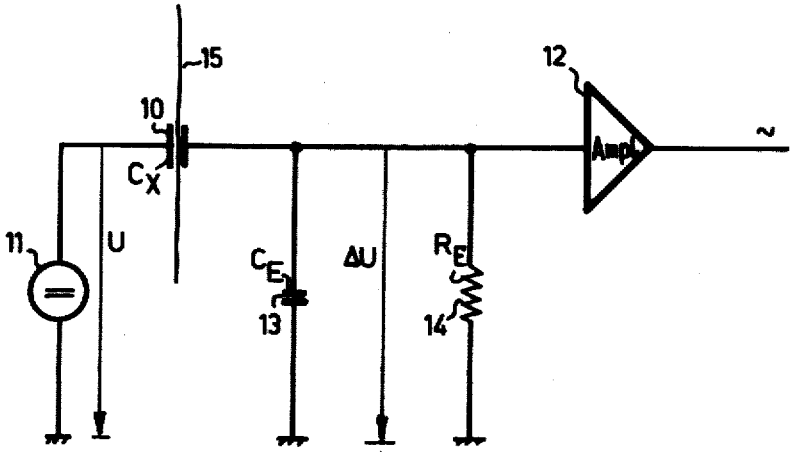
15
10
12
Amp
~
$C_X$
11
U
$C_E$
13
ΔU
$R_E$
14

CAPACITIVE THREAD STOPPING MOTION

The invention relates to a method of detecting a running thread and to a capacitive thread stopping and motion detecting device.

Thread stopping and motion detecting devices which clearly show the presence of a running thread at specified positions are required for monitoring production plants in the textile industry. Such thread stopping and motion detecting devices have already been in use for a long time. They may be in the form of mechanical thread detectors or they may be optical or thermoelectrical detectors. Mechanical detectors have the disadvantage that they have to touch the thread continuously and may thus damage the thread structure, and they display the location of a thread breakage after a delay owing to their mechanical inertia. In addition, they require the continuous presence of thread tension since they are generally designed to use the thread to hold a detecting lever in a suspended position. Optical thread stopping and motion detecting devices require a complicated arrangement of light source and light receiver with a high consumption in energy when used comprehensively, and the reliability of the light source and light receiver is greatly impaired by unavoidable deposits of fiber dust.

Thermoelectrical thread stopping and motion detecting devices have also been suggested more recently, but these have the similar disadvantage of thermal inertia; the time interval from the moment of the thread breakage until a measurable change appears in the electrical operating value of these devices may be kept small by relevant structural measures, but cannot be excluded altogether.

According to the present invention, there is provided a capacitive thread stopping and motion detecting device which is arranged definitely to display the presence of a running thread by emitting a relevant signal in such a way that the signal fails immediately when a running thread is absent, the said motion comprising a precision capacitor through which a thread to be monitored can run to form a portion of the dielectric of the capacitor, the precision capacitor being connected to a direct voltage source for producing an electric field and to an amplifier with a high input resistance.

The natural irregularity in the cross section of the thread is used advantageously in that such irregularity only produces an alternating voltage in the precision capacitor when the thread runs, and this voltage is processed in the amplifier as an alternating current signal. When the thread is stationary or absent, there is no alternating voltage and this forms a clear criterion for the passage of a thread.

The single FIGURE of the accompanying drawing is a schematic circuit diagram illustrating a capacitive thread stopping and motion detecting device according to the present invention.

In the illustrated arrangement, a precision capacitor 10 has one of its electrodes connected to a direct voltage source 11 and the other electrode is connected to the input of an amplifier 12. The electrical input characteristic of the amplifier 12 is represented by an input capacitance 13 ($C_e$) and an input resistance 14 ($R_E$). A thread 15 traveling between the electrodes of the capacitor 10 causes a change in capacitance $\Delta C$ in the capacitor 10. During the passage of a thread 15, this variation in the capacitance amounts to about $10^{-16}$ F. The time constant $(C_X+C_E)\cdot R_E=\tau$ must be large in relation to the period in which the change of capacitance takes place.

An alternating voltage $\Delta U$ is then produced by the capacitive divider $C_X$ and $C_E$:

$$\Delta U = \frac{U \cdot C_E}{\frac{(C_X + C_E)^2}{\Delta C} + C_E + C_X}$$

After the period $\tau$, the voltage $\Delta U$ has dropped to 37%. This means that it is not possible to measure the cross section of the thread over a longer period with the capacitive thread stopping and motion detecting device. On the other hand, momentary variations in the cross section of the yarn (i.e., its irregularity) may be determined. They produce an alternating voltage signal when the thread 15 is moved through the precision capacitor 10. In the case of a stand-still or thread breakage, the alternating voltage signal disappears immediately, representing a thread stopping condition.

The irregularity of endless yarns is generally very slight so that the information signal may disappear in the background noise under certain circumstances. However, in these cases, the static charge occurring with good insulating materials, which is always distributed very irregularly on the thread, nonetheless produces an alternating voltage signal by electrostatic induction.

With poor insulating materials, say moist or antistatically treated endless yarns, a varying resistance placed by the thread between the plates of the precision capacitor 10 may also lead to a useful alternating voltage signal in some cases.

While I have shown and described one embodiment in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are obvious to one of ordinary skill in the art.

What is claimed is:

1. A capacitive thread stopping and motion detecting device which is arranged definitely to display the presence of a running thread by emitting a relevant signal in such a way that the signal fails immediately when the running thread is absent, comprising a direct current source, an amplifier having a high input resistance, and a precision capacitor through which a thread to be monitored can run to form a portion of the dielectric of the capacitor, the precision capacitor being connected to said direct voltage source for producing an electric field between the plates thereof and to the input of said amplifier which produces an alternating current output in response to variations in the capacitance of said capacitor resulting from the running of the thread therethrough.

2. A capacitive thread stopping and motion detecting device as defined in claim 1, further comprising a capacitance connected to the input of the amplifier and forming together with the precision capacitor a capacitive divider.

3. A method of detecting the presence of a running thread comprising detecting the inherent physical irregularities in the running thread and generating an alternating current signal in response to said detected irregularities, said step of detecting including measuring the variations in static charge on the running thread.

4. A method of detecting the presence of a running thread comprising detecting the inherent physical irregularities in the running thread and generating an alternating current signal in response to said detected irregularities, the step of detecting including passing the running thread through a capacitor connected to a direct current source and to the input of an amplifier having a high input resistance.

5. A method of detecting the presence of a running thread comprising detecting the inherent physical irregularities in the running thread and generating an alternating current signal in response to said detected irregularities, the step of detecting including passing the running thread through a first capacitor connected to a direct current source, to a second capacitor and to the input of an amplifier having a high input resistance, the first capacitor and second capacitor forming a capacitive divider.

* * * * *